United States Patent [19]

Slomski

[11] 4,098,422

[45] Jul. 4, 1978

[54] PLASTIC BOTTLE STOPPER

[76] Inventor: Lawrence J. Slomski, 810 E. 11th St., Erie, Pa. 16503

[21] Appl. No.: 780,542

[22] Filed: Mar. 23, 1977

Related U.S. Application Data

[63] Continuation-in-part of Ser. No. 678,624, Apr. 20, 1976, abandoned.

[51] Int. Cl.[2] ..... B65D 39/00

[52] U.S. Cl. ..... 215/355

[58] Field of Search ..... 215/320, 354, 355

[56] References Cited

U.S. PATENT DOCUMENTS

| | | | |
|---|---|---|---|
| 2,196,785 | 4/1940 | Takiguchi | 215/355 |
| 3,186,573 | 6/1965 | Salminen | 215/354 X |
| 3,191,790 | 6/1965 | Coven | 215/354 X |

FOREIGN PATENT DOCUMENTS

| | | | |
|---|---|---|---|
| 62,450 | 1/1955 | France | 215/355 |
| 67,788 | 10/1957 | France | 215/355 |
| 507,500 | 12/1954 | Italy | 215/355 |
| 825,448 | 12/1959 | United Kingdom | 215/355 |

*Primary Examiner*—George T. Hall

*Attorney, Agent, or Firm*—Charles L. Lovercheck

[57] ABSTRACT

A bottle stopper made of plastic material having a hollow, tubular, generally cylindrical body closed at one end with axially extending grooves molded in the inside. The grooves extend approximately 2/3 of the way through the wall of the hollow, tubular cylindrical body, providing flexibility for the stopper to make it fit better into the neck of the bottle and maintain pressure and allow easier capping and easier removal and greater security of the bottle.

2 Claims, 6 Drawing Figures

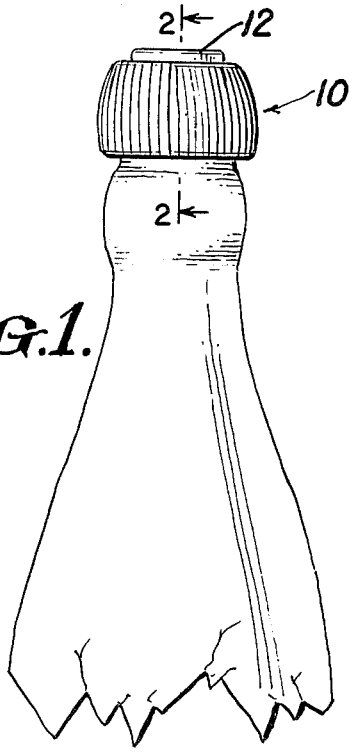
FIG. 1.
FIG. 2.
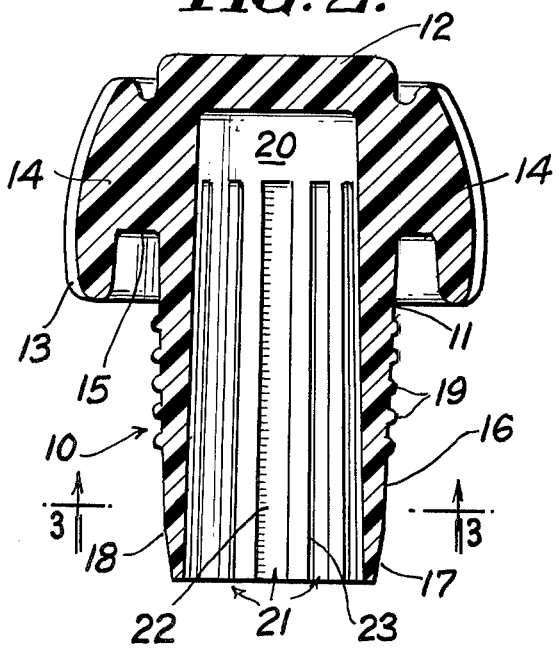
FIG. 3.
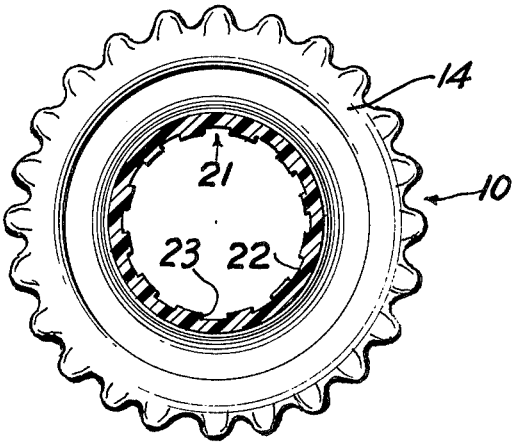
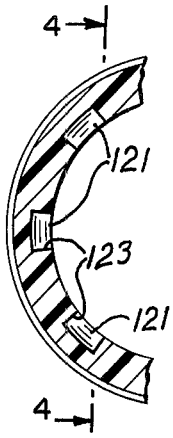
FIG. 6.
FIG. 4.
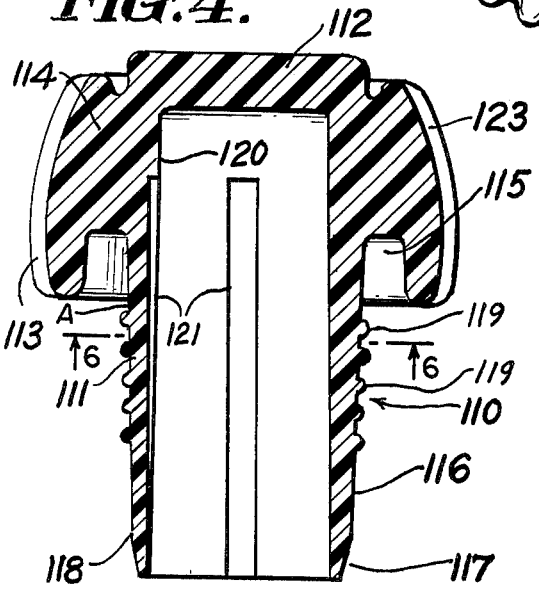
FIG. 5.
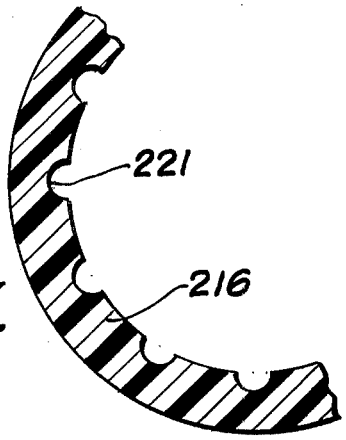

PLASTIC BOTTLE STOPPER

REFERENCE TO PRIOR APPLICATION

This application is a Continuation-In-Part of U.S. Pat. application Ser. No. 678,624 filed Apr. 20, 1976, now abandoned.

GENERAL STATEMENT OF THE INVENTION

Stoppers for bottles such as champagne bottle stoppers that are subjected to the pressure of the fermenting beverage are inclined to pop out inadvertently. Many of these stoppers even tend to move outwardly a small amount when first introduced into the bottle and to creep out a short distance when first capped. The stopper according to the embodiment of this invention has axially-extending internal slots that render the stopper more flexible to accommodate itself to the inside of the bottle neck.

REFERENCE TO PRIOR ART

Prior U.S. Pat. Nos. 2,820,564; 3,186,573; and 3,335,893 show grooves or rings on bottle stoppers, but none of them have the arrangement of grooves of the proportions set forth herein for the purpose set forth.

OBJECTS OF THE INVENTION

It is an object of the invention to provide an improved beverage bottle stopper.

Another object of the invention is to provide a bottle stopper that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a longitudinal, partial side view of a bottle stopper and bottle according to the invention.

FIG. 2 is a longitudinal, cross-sectional view taken on line 2—2 of FIG. 1.

FIG. 3 is a cross-sectional view taken on line 3—3 of FIG. 2.

FIG. 4 is a cross-sectional view similar to FIG. 4 of another embodiment of the invention.

FIG. 5 is a cross-sectional view similar to FIG. 6 of another embodiment of the invention.

FIG. 6 is a cross-sectional view taken on line 6—6 of FIG. 4.

DETAILED DESCRIPTION OF THE DRAWINGS

Now, with more particular reference to the drawings, the bottle stopper is indicated generally at 10. It has a hollow, tubular, generally cylindrical body 11 closed at one end by an end member 12. The stopper has a flange 13 that is integrally molded to the hollow body adjacent the closed end 12 by the intermediate material 14 which defines a flat shoulder 15 that may rest against the lip of a champagne bottle or the like. The flange 13 has the axially-extending grooves 21 in it which enhance the appearance of the stopper and make it easier for the user to grip the stopper for insertion or removal thereof. The outer surface of the tubular, cylindrical body 11 has a generally cylindrical surface 16 which tapers slightly away from the shoulder 15 and joins the outer conical surface 17 which tapers inwardly at a greater rate than the surface 16, and the surface 16 joins the surface 17 and 18. Circumferentially-spaced ribs 19 are molded onto the outer periphery of the surface 16. These ribs facilitate the sealing of the bottle by the stopper.

The inner periphery 20 of the stopper is generally cylindrical but it tapers inwardly toward the closed end so that the inner diameter of the inner periphery 20 adjacent the closed end is considerably less than that adjacent the open end.

Axially-extending, circumferentially-spaced grooves 21 are formed in the inner periphery of the cylindrical portion 11. These grooves may have a flat bottom 22 and flat edges 3 extending inwardly, generally perpendicular to the bottom surface 22. Characteristically, when the wall thickness of the stopper is between 0.027 and 0.100 inches, the grooves 21 will be between 0.005 and 0.020 inches. Grooves 21 will have an arcuate bottom surface 22. The grooves 21 may be approximately the same proportional depth relative to the wall thickness as the grooves in the embodiment of FIG. 1.

In the embodiment of the invention shown in FIGS. 4 and 6, I show another embodiment of the stopper. In FIGS. 4 and 6, stopper 110 has a generally cylindrical body 111 closed by end 112. The stopper has a flange 113 that is integrally molded to the hollow body adjacent the closed end 112 by the intermediate material 114 which defines a flat shoulder 115 that may rest against the lip of a champagne bottle or the like. The flange 113 has the axially-extending grooves 123 in it which enhance the appearance of the stopper and make it easier for the user to grip the stopper for insertion or removal thereof.

The outer surface of the tubular cylindrical part 111 has a cylindrical surface 116 which tapers slightly away from the shoulder 115 and joins the outer conical surface 117 which tapers inwardly at a greater rate than surface 16 and joins the surface 117 at 118. Circumferentially-spaced ribs 119 are molded onto the outer periphery of the surface 116. These ribs facilitate sealing of the bottle with the stopper. The inner periphery 120 of the stopper is generally cylindrical, but it tapers inwardly toward the closed end so that the inner diameter of the inner periphery 120 of the stopper adjacent the closed end is considerably less than that adjacent the open end.

Circumferentially-extending, five axially-spaced grooves 121 are formed in the inner periphery of the cylindrical portion 111. These grooves may have a flat bottom but preferably have an arcuate bottom and flat edges 123.

Characteristically, when the wall thickness of the stopper is between 0.027 and 0.100 inches, the grooves 121 will be between 0.005 and 0.020 inches. The part 116 of the stopper is substantially cylindrical. The wall thickness at A is preferably 0.104 inches, at B is 0.070 inches and at C is 0.070 inches.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A stopper comprising, a hollow, generally tubular body adapted to be inserted into the mouth of a bottle neck, said hollow body being closed at one end and having an open end, said hollow body having a generally cylindrical inside surface, tapering outward toward said open end, and only five circumferentially spaced, axially-extending grooves in said inside surface extending from adjacent the closed end to the open end providing flexibility for said stopper whereby said stopper is less likely to be forced out of said bottle mouth, said body having a generally cylindrical first outside surface adjacent said closed end and a second generally cylindrical outside surface joining said first said surface, and a third outside surface extending from said second outside surface to the open end of said hollow body, said first outside surface tapering slightly inwardly and toward said open end, said second outside surface being cylindrical and said third outside surface tapering inwardly and toward said open end at a greater angle than said first outside surface, said grooves having relatively flat bottoms and relatively flat side edges, the depth of said grooves increasing from said open end toward said closed end, the wall thickness of said body at said grooves adjacent said closed ends being between 0.027 inches and 0.100 inches and said grooves adjacent said open ends being approximately 0.020 inches deep and are approximately $\frac{1}{8}$ inch wide, said hollow body having a flange supported thereon concentric to said hollow body at said closed end, cylindrical flange extending generally concentric to said hollow body and spaced outwardly therefrom and adapted to receive the end of the neck of the champagne bottle between said flange and said hollow body, 2. The stopper recited in claim 1 wherein said first outside surface has circumferentially-extending, axially-spaced beads thereon.

* * * * *